United States Patent [19]

Kopatz et al.

[11] Patent Number: 4,808,217

[45] Date of Patent: Feb. 28, 1989

[54] PROCESS FOR PRODUCING FINE SPHERICAL PARTICLES HAVING A LOW OXYGEN CONTENT

[75] Inventors: Nelson E. Kopatz; Lori S. Pruyne, both of Sayre, Pa.

[73] Assignee: GTE Products Corporation, Stamford, Conn.

[21] Appl. No.: 197,559

[22] Filed: May 23, 1988

[51] Int. Cl.[4] ..... B22F 9/08

[52] U.S. Cl. ..... 75/0.5 B; 75/0.5 BA; 75/0.5 BB; 264/15

[58] Field of Search ..... 75/0.5 B, 0.5 BA, 0.5 BB; 264/15

[56] References Cited

U.S. PATENT DOCUMENTS

| | | | |
|---|---|---|---|
| 3,909,241 | 8/1975 | Cheney et al. | 75/0.55 B |
| 3,974,245 | 8/1976 | Cheney et al. | 264/10 |
| 4,502,885 | 3/1985 | Cheney | 75/0.5 B |
| 4,592,781 | 6/1986 | Cheney et al. | 75/249 |
| 4,711,660 | 12/1987 | Kemp et al. | 75/0.5 B |
| 4,711,661 | 12/1987 | Pemp et al. | 75/0.5 B |
| 4,743,297 | 5/1988 | Kopatz et al. | 75/0.5 B |

*Primary Examiner*—Wayland Stallard

*Attorney, Agent, or Firm*—Donald R. Castle; L. Rita Quatrini

[57] ABSTRACT

A process is disclosed for producing fine spherical particles from a starting fine powder material which comprises entraining the powder material in a carrier gas, passing the powder material and the carrier gas through a high temperature zone, and maintaining the powder in the high temperature zone for a sufficient time to melt at least about 50% by weight of the particles of the powder and to form spherical particles of the melted portion, allowing the high temperature treated material to come in contact with a reducing atmosphere created by a stream of hydrogen gas, and thereafter rapidly solidifying the resulting high temperature treated material to form spherical particles wherein the oxygen content of the spherical particles is reduced by greater than about 10% by weight from the starting powder.

2 Claims, No Drawings

PROCESS FOR PRODUCING FINE SPHERICAL PARTICLES HAVING A LOW OXYGEN CONTENT

This invention relates to a process for producing fine spherical particles having a low oxygen content wherein a starting powder is high temperature processed and thereafter allowed to come in contact with a stream of hydrogen gas before cooling.

BACKGROUND OF THE INVENTION

Fine spherical powders, especially alloy or elemental metal powders can be made by high temperature processing. Such processes are described in U.S. Pat. Nos. 3,909,241, 3,974,245, 4,592,781, 4,715,878, 4,502,885, 4,711,660, and 4,711,661. One of the problems that occurs in this processing, especially plasma processing, is that the resulting fine spherical powder tends to be high in oxygen levels. This is detrimental because presence of oxygen decreases compressibility, sinterability, and mechanical properties and electrical condictivity, etc. of the sintered compacts.

It would be a significant advance in the art to assure that spherical powder particles which are produced by high temperature processing are low in oxygen content to avoid the above described disadvantages.

SUMMARY OF THE INVENTION

In accordance with one aspect of this invention, there is provided a process for producing fine spherical particles from a starting fine powder material which comprises entraining the powder material in a carrier gas, passing the powder material and the carrier gas through a high temperature zone, and maintaining the powder in the high temperature zone for a sufficient time to melt at least about 50% by weight of the particles of the powder and to form spherical particles of the melted portion, allowing the high temperature treated material to come in contact with a reducing atmosphere created by a stream of hydrogen gas, and thereafter rapidly solidifying the resulting high temperature treated material to form spherical particles wherein the oxygen content of the spherical particles is reduced by greater than about 10% by weight from the starting powder.

DETAILED DESCRIPTION OF THE INVENTION

For a better understanding of the present invention, together with other and further objects, advantages and capabilities thereof, reference is made to the following disclosure and appended claims in connection with the above description of some of the aspects of the invention.

The present invention provides a method for high temperature processing of powder to produce spherical particles which are consistently low in oxygen content. The spherical particle powders thus produced are more compressible, sinterable, have improved mechanical properties, and electrical conductivities over the higher oxygen content powders.

This invention is applicable to any powder material. However, it is especially suited to metal powders and metal alloy powders such as tungsten metal and alloy powders, iron-cobalt alloys, other iron-based alloys, and cobalt metal powders.

The starting fine powder material is entrained in a carrier gas such as argon and passed through the high temperature zone and maintained in the high temperature zone at a temperature above the melting point of the powder for a sufficient time to melt at least about 50% by weight of the powder and form spherical particles of the melted portion. Some additional powder particles can be partially melted or melted on the surface and these can be spherical particles in addition to the portion of completely melted particles. The preferred high temperature zone is a plasma.

Details of the principles and operation of plasma reactors are well known. The plasma has a high temperature zone, but in cross section the temperature can vary typically from about 5500° C. to about 17,000° C. The outer edges are at low temperatures and the inner part is at a higher temperature. The retention time depends upon where the particles entrained in the carrier gas are injected relative to the nozzle of the plasma gun. Thus, if the particles are injected into the outer edge, the retention time must be longer, and if they are injected into the inner portion, the retention time is shorter. The residence time in the plasma flame can be controlled by choosing the point at which the particles are injected into the plasma. Residence time in the plasma is a function of the physical properties of the plasma gas and the powder material itself for a given set of plasma operating conditions and powder particles. Larger particles are more easily injected into the plasma while smaller particles tend to remain at the outer edge of the plasma jet or are deflected away from the plasma jet.

The resulting high temperature treated material is then allowed to come in contact with a reducing atmosphere created by a stream of hydrogen gas. In accordance with a preferred embodiment, the hydrogen gas stream exits a ⅜" spray nozzle such as manufactured by Vortec. The nozzle is positioned about 2" down from the powder port which is the point of entrance of the powder into the high temperature zone, and at about a 90° angle from the direction of the powder port. This creates a reducing atmosphere and allows the high temperature treated material which is mainly in the form of molten particles to come into contact with the hydrogen gas before cooling.

The oxygen content is variably affected by high temperature processing when the contacting with hydrogen step is not done. The oxygen content can increase or decrease by varying degrees, depending on the nature of the powder. When the oxygen content does decrease, it is typically by no more than about 10% by weight over the starting powder. With the step of contacting with a hydrogen gas stream, a reduction in oxygen by greater than about 10% by weight is realized.

As an example of the advantages afforded by the present invention, when tungsten powder containing about 1270 weight parts per million oxygen is plasma processed without the hydrogen gas stream the oxygen level of the resulting spherical particles ranges from as high as about 0.49% to as low as about 0.20% by weight. When the high temperature treated material is contacted with the hydrogen gas stream according to the process of the present invention, the oxygen level in the resulting spherical particles is as low as about 780 weight parts per million.

The high temperature treated material is then rapidly solidified. Generally the major weight portion of the material is converted to spherical particles. Generally greater than about 75% and most typically greater than about 85% of the material is converted to spherical particles by the high temperature treatment. Nearly 100% conversion to spherical particles can be attained. The major portion of the spherical particles are less than about 20 micrometers in diameter. The particle size of the plasma treated particles is largely dependent on the size of the starting powder material.

After cooling and resolidification, the resulting high temperature treated material can be classified to remove the major spheroidized particle portion from the essentially non-spheroidized minor portion of particles and to obtain the desired particle size. The classification can be done by standard techniques such as screening or air classification. The unmelted minor portion can then be reprocessed according to the invention to convert it to fine spherical particles.

Spherical particles have an advantage over non-spherical particles in injection molding and pressing and sintering operations. The lower surface area of spherical particles as opposed to non-spherical particles of comparable size, and the flowability of spherical particles makes spherical particles easier to mix with binders and easier to dewax.

To more fully illustrate this invention, the following nonlimiting example is presented.

EXAMPLE

Fine tungsten powder having a mean size of about 2.5 micrometers and a starting oxygen content of about 1300 weight parts per million is entrained in an argon carrier gas flow of about 7.5 SCFH and passed through a high temperature plasma gas. This gas consists of about 80 SCFH argon and about 15 SCFH helium. The current is about 400 amps and the voltage is about 40, giving a power of about 16 kw. The powder upon exiting the flame enters a reducing atmosphere consisting of a hydrogen gas stream of approximately 30 SCFH. The material is then rapidly solidified and collected. The oxygen content of this material is about 780 weight parts per million compared to contents of about 2000–4000 weight parts per million when the hydrogen is not employed.

While there has been shown and described what are at present considered the preferred embodiments of the invention, it will be obvious to those skilled in the art that various changes and modifications may be made therein without departing from the scope of the invention as defined by the appended claims.

What is claimed is:

1. A process for producing fine spherical particles from a starting fine powder material, said process comprising:

(a) entraining said starting powder material in a carrier gas;

(b) passing said powder material and said carrier gas through a high temperature zone and maintaining said powder in said high temperature zone for a sufficient time to melt at least about 50% by weight of the particles of said powder material and to form spherical particles of the melted portion;

(c) allowing the resulting high temperature treated material to come in contact with a reducing atmosphere created by a stream of hydrogen gas; and (d) rapidly solidifying the resulting high temperature treated material to form spherical particles wherein the oxygen content of said spherical particles is reduced by greater than about 10% by weight from the starting powder.

2. A process of claim 1 wherein said high temperature zone is a plasma.

* * * * *